US011933122B2

(12) United States Patent
Qi et al.

(10) Patent No.: US 11,933,122 B2
(45) Date of Patent: Mar. 19, 2024

(54) SYSTEMS AND METHODS FOR POWER EQUALIZATION FOR MULTIPLE DOWNHOLE TRACTORS

(71) Applicant: Halliburton Energy Services, Inc., Houston, TX (US)

(72) Inventors: Yuan Qi, Houston, TX (US); Sudhir Kumar Gupta, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 120 days.

(21) Appl. No.: 17/590,990

(22) Filed: Feb. 2, 2022

(65) Prior Publication Data

US 2023/0014986 A1 Jan. 19, 2023

Related U.S. Application Data

(60) Provisional application No. 63/222,576, filed on Jul. 16, 2021.

(51) Int. Cl.
*E21B 23/00* (2006.01)
*E21B 23/14* (2006.01)

(52) U.S. Cl.
CPC ..... *E21B 23/001* (2020.05); *E21B 23/14* (2013.01)

(58) Field of Classification Search
CPC ... E21B 23/001; E21B 23/14; F16L 55/30–38
See application file for complete search history.

(56) References Cited

U.S. PATENT DOCUMENTS

| | | | | |
|---|---|---|---|---|
| 6,273,189 | B1 * | 8/2001 | Gissler | E21B 4/04 166/241.1 |
| 9,777,545 | B2 * | 10/2017 | Ludwig | E21B 4/006 |
| 9,874,061 | B2 * | 1/2018 | Bedrossian | E21B 23/00 |
| 11,499,372 | B2 * | 11/2022 | Qi | H02P 5/46 |
| 2002/0029908 | A1 * | 3/2002 | Bloom | E21B 4/18 166/212 |

(Continued)

FOREIGN PATENT DOCUMENTS

| | | | | |
|---|---|---|---|---|
| EP | 4163472 | A1 * | 4/2023 | |
| WO | WO-2009047729 | A2 * | 4/2009 | E21B 4/04 |

OTHER PUBLICATIONS

Filing Receipt, Specification and Drawings for U.S. Appl. No. 63/222,576 entitled "Systems and Methods for Power Equalization for Multiple Downhole Tractors," filed Jul. 16, 2021, 32 pages.

(Continued)

*Primary Examiner* — Jennifer H Gay
(74) *Attorney, Agent, or Firm* — Conley Rose, P.C.; Rodney B. Carroll

(57) ABSTRACT

Downhole tractor control systems and methods to maintain a load among multiple tractors are disclosed. A method to adjust a load among multiple tractors includes receiving first power feedback of a first downhole tractor, receiving second power feedback of a second downhole tractor, identifying an unbalance load condition when a difference between the first power feedback and the second power feedback exceeds a predetermined threshold, and adjusting, in response to identifying the unbalance load condition and based on the difference, power reference of the first downhole tractor and the second downhole tractor.

17 Claims, 7 Drawing Sheets

(56) References Cited

U.S. PATENT DOCUMENTS

2002/0112859 A1* 8/2002 Bloom ..... E21B 23/04 166/212
2005/0145415 A1* 7/2005 Doering ..... E21B 4/18 175/24
2006/0196694 A1* 9/2006 Bloom ..... E21B 7/062 175/90
2008/0135292 A1* 6/2008 Sihler ..... E21B 44/005 175/27
2008/0308318 A1* 12/2008 Moore ..... E21B 4/18 175/51
2009/0091278 A1* 4/2009 Montois ..... H02P 5/46 318/400.15
2009/0218105 A1* 9/2009 Hill ..... E21B 4/18 166/241.1
2010/0314173 A1* 12/2010 Hbaieb ..... E21B 44/005 175/57
2015/0167416 A1* 6/2015 Ludwig ..... E21B 4/006 166/385
2016/0333653 A1* 11/2016 Bonderover ..... E21B 4/18
2016/0362953 A1* 12/2016 Bedrossian ..... E21B 4/18
2020/0270979 A1* 8/2020 Hradecky ..... E21B 47/12
2021/0123303 A1* 4/2021 Qi ..... H02P 5/46
2021/0254422 A1* 8/2021 Sheiretov ..... E21B 23/01
2023/0014986 A1* 1/2023 Qi ..... E21B 23/001
2023/0020636 A1* 1/2023 Qi ..... E21B 23/14
2023/0110460 A1* 4/2023 Andersen ..... E21B 23/14 166/381
2023/0112474 A1* 4/2023 Thomsen ..... H02P 23/14 166/385
2023/0112756 A1* 4/2023 Andersen ..... E21B 23/001 166/65.1

OTHER PUBLICATIONS

Filing Receipt, Specification and Drawings for U.S. Appl. No. 63/222,574, entitled "System and Apparatus for Power Maximization for Downhole Tractor," filed Jul. 16, 2021, 33 pages.
Filing Receipt, Specification and Drawings for U.S. Appl. No. 17/590,987 entitled "Systems and Methods for Power Maximization for Downhole Tractor," filed Feb. 2, 2022, 37 pages.

* cited by examiner

SYSTEMS AND METHODS FOR POWER EQUALIZATION FOR MULTIPLE DOWNHOLE TRACTORS

CROSS-REFERENCE TO RELATED APPLICATIONS

This application claims priority to U.S. Provisional Application No. 63/222,576 filed on Jul. 16, 2021 and entitled, "Systems and Methods for Power Equalization for Multiple Downhole Tractors." The disclosure of the aforementioned application is hereby incorporated by reference in its entirety.

TECHNICAL FIELD

The present application relates generally to downhole tractor control systems and methods to adjust or balance a load among multiple downhole tractors.

BACKGROUND

Downhole equipment used in various downhole operations including, but not limited to, drilling operations, completion operations, wireline operations, logging operations, as well as other well operations, are sometimes performed by downhole tractors that are deployed in a wellbore. In some downhole tractor applications, multiple downhole tractors are simultaneously used to carry a heavy payload in long horizontal wells. In such multiple tractor applications, the downhole tractors are controlled separately and cannot adjust the output power based on other tractors' performance. As a result, the applied tractors may run with unbalanced output power, which may cause some downhole tractors to run with higher output power than other downhole tractors. The unbalanced power among downhole tractors can cause mechanical and thermal stress on various power carrying parts (e.g., motors, transmission systems, etc.) of the downhole tractors. Depending on the overall power draw, this may further limit the net pull force of the tractors.

BRIEF DESCRIPTION OF DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
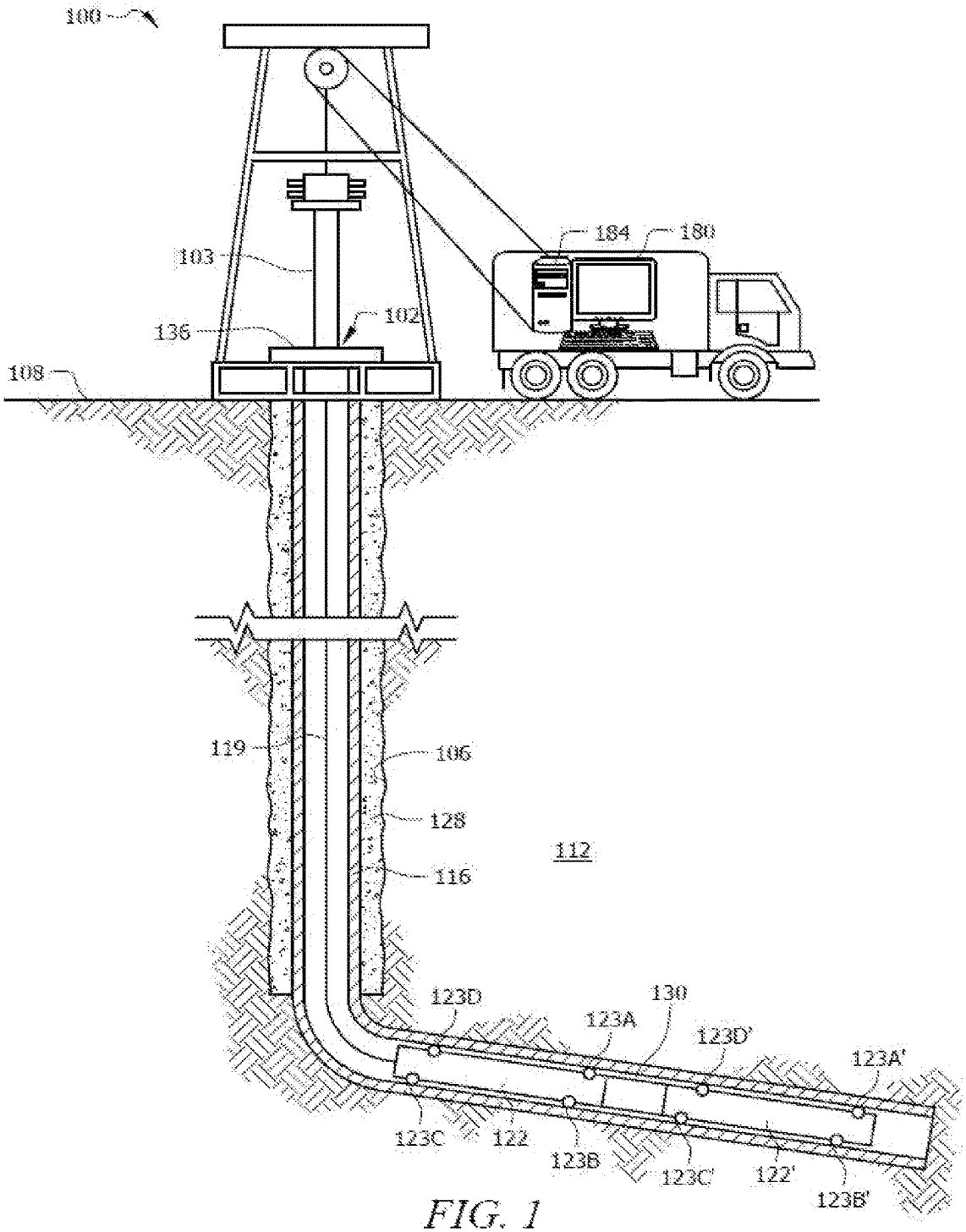
FIG. 1 illustrates a schematic side view of a well having multiple downhole tractors deployed in a wellbore of the well in accordance with embodiments of the present disclosure.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As described in the background section, in some applications, multiple downhole tractors may be simultaneously used to carry a heavy payload in long horizontal wells. Each downhole tractor has one or more motors powering rotation of wheels that permit traction on a wall of a casing or a wellbore. While each downhole tractor is traversing in the wellbore, in some conditions, different properties of the wheels and different operating conditions of motors may cause malfunctioning or reduction in output power in one or more tractors. As the multiple tractors are controlled separately, these conditions may cause the output power to unbalance between tractors.

The present disclosure relates to downhole tractor control systems and methods to adjust or balance/equalize a load among multiple downhole tractors when one or more tractors are malfunctioning or the driving wheels of one or more tractors are slipping. In some embodiments, two or more downhole tractors may be connected in a tool string deployed in the casing for moving within the wellbore. Although two downhole tractors coupled with each other are preferred in some applications, those of skill in the art will understand that more than two tractors may be used and the tractors may be separated by other downhole tools.

In some embodiments, the downhole tractor control system refers to any system operable to balance/adjust a load among multiple downhole tractors based on power feedback from each tractor. The downhole tractor control system may be either placed at a surface of a well or coupled to the download tractors in the wellbore. In some embodiments, the downhole tractor control system may receive feedbacks of the power from each tractor and send back the power/speed reference commands to the multiple tractors coupled together to adjust the load among them. In some embodiments, the downhole tractor control system may be configured to employ a power equalizer or a power equalization algorithm for equalizing the power of each tractor based on the power difference between the tractors.

In some embodiments, the downhole tractor control system may receive first power feedback of a first downhole tractor and second power feedback of a second downhole tractor. The downhole tractor control system may identify an unbalance load condition when a difference between the first power feedback and the second power feedback exceeds a predetermined threshold. The downhole tractor control system may then adjust power reference (a.k.a desired input power) of each tractor based on identifying the unbalance load condition and the power difference between the tractors. In some embodiments, to adjust the load among the tractors, the downhole tractor control system may be further configured to increase the power reference for the first downhole tractor that has lower output power and decrease the power reference for the second tractor that has higher output power. In this way, the downhole tractor control system may balance the power consumption of multiple tractors applied on the same tool string and maintain the downhole tractors operating identically. The system and techniques described herein may confer multiple technical advantages. For instance, the power balance between the tractors may improve the reliability of the tractor system by avoiding stress on one of the tractors and reduce the failure rate caused by excessive usage. Furthermore, the power balance between the tractors may also increase utilization of the installed pull force capacity in adverse conditions and allow more run time without exceeding temperature limits of the power carrying components (e.g., motors, transmission systems) of the tractors, thus enabling the tractors to be deployed for deeper wells with long horizontal sections.

In some embodiments, the downhole tractor control system may receive user inputs/commands of a desired power of each tractor and input of run-time power consumption (i.e. actual power/power feedback) of each tractor. The downhole tractor control system may then utilize feedback controllers to calculate an error between user-desired power and power feedback for each tractor. The downhole tractor control system may then obtain modified power reference for each tractor as output based on the error. In some embodiments, change in power may also be accomplished by sending slightly different speed commands to the tractors. In an aspect, slightly different speed commands refer to speed commands that differ in speed (e.g., distance travelled per unit time) in a range of from about greater than zero and less than or equal to 15%, from about greater than zero and less than or equal to 10%, or from about greater than zero and less than or equal to 5%. In some embodiments, a first downhole tractor that has higher output power may receive lower speed reference such that it can slow down and reduce its power to match with a second downhole tractor, and the second downhole tractor that has lower output power may receive higher speed reference such that it can speed up and increase its power to match with the first downhole tractor. Thus, the tractors with higher speed command may carry higher output power and the tractors with lower speed command may carry lower output power to balance the load among the tractors. Additional descriptions of the downhole tractor control systems and methods to adjust a load among multiple downhole tractors are provided in the paragraphs below and are illustrated in at least FIGS. 1-6.

FIG. 1 illustrates a schematic side view of an environment 100, where at least two downhole tractors 122 and 122' may be deployed in a wellbore 106 of a well 102. In the embodiment of FIG. 1, the wellbore 106 may extend from a surface 108 of the well 102 to or through a formation 112. A casing 116 is deployed along the wellbore 106 to insulate downhole tools and strings deployed in the casing 116 to provide a surface that contacts wheels 123A-123D of the downhole tractor 122 and wheels 123A'-123D' of the downhole tractor 122', to provide a path for hydrocarbon resources flowing from the subterranean formation 112, to prevent cave-ins, and/or to prevent contamination of the subterranean formation 112. The casing 116 may be normally surrounded by a cement sheath 128, which is deposited in an annulus between the casing 116 and the wellbore 106 to fixedly secure the casing 116 to the wellbore 106 and to form a barrier that isolates the casing 116. Although not depicted, there may be layers of casing concentrically placed in the wellbore 106, each having a layer of cement or the like deposited thereabout.

A conveyance 119, optionally carried by a vehicle 180, may be positioned proximate to the well 102. The conveyance 119, along with the downhole tractors 122 and 122', may be lowered down the wellbore 106, i.e. downhole. The downhole tractors 122 and 122' may be coupled to each other through a joint 130. In one or more embodiments, the conveyance 119 and the downhole tractors 122 and 122' may lowered downhole through a blowout preventer 103 and a wellhead 136. In the illustrated embodiment of FIG. 1, the conveyance 119 may be a wireline. In one or more embodiments, the conveyance 119 may be wireline, slickline, coiled tubing, drill pipe, production tubing, fiber optic cable, or another type of conveyance operable to deploy the downhole tractors 122 and 122'. The conveyance 119 may provide mechanical suspension of the downhole tractors 122 and 122'. In one or more embodiments, the conveyance 119 may also transmit signals including, but not limited to, optical signals to the downhole tractors 122 and 122'. In one or more embodiments, the conveyance 119 also may provide power to the downhole tractors 122 and 122' as well as other downhole components. In one or more embodiments, the conveyance 119 may also provide downhole telemetry. Additional descriptions of telemetry are provided in the paragraphs below. In one or more embodiments, the conveyance 119 may also provide a combination of power and downhole telemetry to the downhole tractors 122 and 122'. For example, where the conveyance 119 may be a wireline, coiled tubing (including electro-coiled-tubing), or drill pipe, power and data are transmitted along with the conveyance 119 to the downhole tractors 122 and 122'.

In the illustrated embodiment of FIG. 1, the downhole tractors 122 and 122' may carry a load downhole during well operations. The downhole tractor 122 may include four wheels 123A-123D and the downhole tractor 122' may include four wheels 123A'-123D' that are attached to extending arms (not shown) which apply traction to the wall of the casing 116 or the wellbore 106 to facilitate movement of the downhole tractors 122 and 122'. In some embodiments, the wheels 123A-123D and 123A'-123D' may roll over tracks (not shown) that are placed on the wall of casing 116 or the wellbore 106. The downhole tractor 122 and 122' may also have motors (not shown) that provide power to rotate the wheels 123A-123D and 123A'-123D' respectively. In some embodiments, the downhole tractor 122 may have multiple motors, each configured to provide power to rotate a separate wheel. In some embodiments, each motor of the downhole tractors 122 and 122' may be configured to provide power to rotate a different set of wheels (e.g., wheels that are coupled to the same axle). In some embodiments, the wheels 123A-123D and 123A'-123D' may have teeth or other profiles that improve adhesion and help the wheels to maintain a grip on the tracks while moving on the tracks.

Over time, the wheels 123A-123D and 123A'-123D' may experience wear, thereby causing diameters of different wheels 123A-123D and 123A'-123D' to differ from each other. In some embodiments, different downhole conditions (e.g., presence of oil on the tracks) may also cause different wheels to experience varying amounts of slippage. While each downhole tractor is traversing in the wellbore, in some conditions, different properties of the wheels and different operating conditions of motors may cause malfunctioning or reduction in output power in one or more tractors. As the multiple tractors are controlled separately, these conditions may cause the output power to unbalance between tractors, and the net pull force available from the tractor may decrease. The downhole tractors 122 and 122' may comprise a downhole tractor control system (illustrated in FIG. 2 and FIG. 3) configured to balance a load among multiple downhole tractors based on power feedback from each tractor and to adjust the output power to each tractor accordingly.

In some embodiments, a downhole tractor control system may include a storage medium and processors (e.g., a digital signal processor (DSP) or the like). The storage medium may be formed from data storage components such as, but not limited to, read-only memory (ROM), random access memory (RAM), flash memory, magnetic hard drives, solid-state hard drives, CD-ROM drives, DVD drives, floppy disk drives, as well as other types of data storage components and devices. In some embodiments, the storage medium includes multiple data storage devices. In further embodiments, the multiple data storage devices may be physically stored at different locations. Data indicative of wellbore conditions, the load on the downhole tractors, as well as other data used to adjust the motor output of the motors of the downhole tractor are stored at a first location of storage medium. Additional descriptions of operations performed by the downhole tractor control system to maintain the load of the downhole tractors are provided in the paragraphs below and are illustrated in at least FIGS. 2-6.

Figure 2:
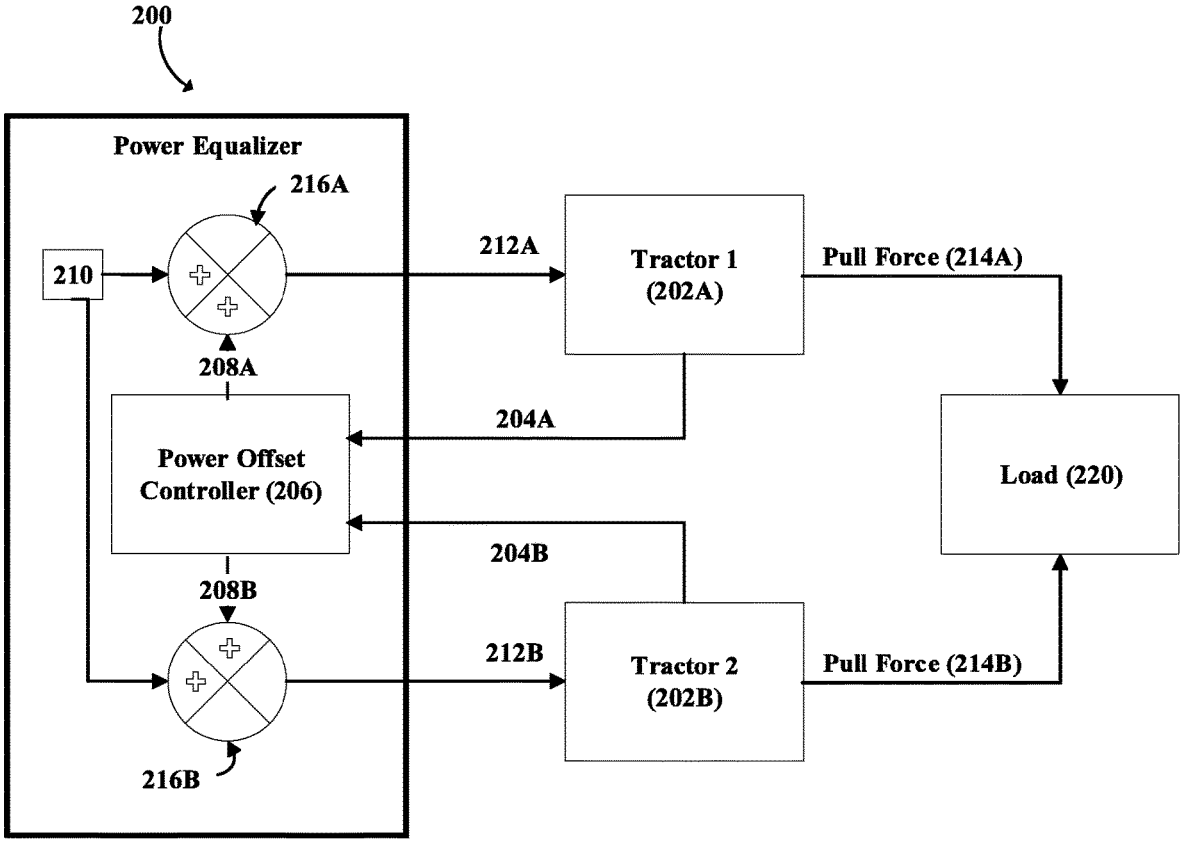
FIG. 2 illustrates a system diagram of a downhole tractor control system configured to balance a load among multiple downhole tractors in accordance with embodiments of the present disclosure.

FIG. 2 illustrates a system diagram of a downhole tractor control system 200 configured to balance a load 220 among the downhole tractors 122 and 122' of FIG. 1 by adjusting the power reference of each tractor in accordance with embodiments of the present disclosure. The downhole tractor control system 200 may be either deployed on a surface-based electronic device, such as controller 184 of FIG. 1, or coupled to the download tractors in the wellbore. In one or more embodiments, downhole tractor control system 200 may include telemetry systems operable to transmit data between the downhole tractors 122 and 122', and the controller 184 of FIG. 1. In one or more of such embodiments, downhole tractor control system 200 may also include transmitters, receivers, transceivers, as well as other components used to transmit data between the downhole tractors 122 and 122' and the controller 184 of FIG. 1.

As shown in FIG. 2, in particular, the downhole tractor control system 200 may be configured to adjust an output power/load 220 between a first tractor 202A and a second tractor 202B connected in a tool string deployed in the casing 116. In some embodiments, the downhole tractors may be more than two. In some embodiments, each downhole tractor may comprise permanent magnet synchronous machine (PMSM) motors powering rotation of wheels. In some embodiments, some downhole tractors may differ with different types of motors and a different number of motors. For example, each downhole tractor may have four motors such as induction motors, DC motors, or other types of motors.

As shown in FIG. 2, block 210 may represent power reference of each tractor, which is equal to the total power/load 220 of all the tractors divided by a number of tractors. In some embodiments, the power reference may be equal to the sum of total power/load 220 of all the tractors divided by a number of tractors and loss of the system. The power reference may be a desired input power of each tractor. In some embodiments, an operator may enter the power reference for each tractor. In some embodiments, the downhole tractor control system may dynamically determine the power reference based on current wellbore conditions as well as the load on downhole tractors.

In some embodiments, the downhole tractor control system may receive power feedback (a.k.a run-time power or actual power) of each tractor and then may calculate a difference between power feedback of each tractor. In some embodiments, the downhole tractor control system may employ a power equalizer using a power equalization algorithm for equalizing the power of each tractor based on the power difference between tractors. The power equalizer may comprise a power offset controller 206 and a summing junction.

As shown in FIG. 2, the power offset controller may receive power feedback 204A, 204B from each tractor 202A, 202B respectively, and provide an output such as a power reference offset 208A and power reference offset 208B for each tractor 202A, 202B respectively. The power offset controller may determine the power reference offset (e.g., 208A and 208B) for each tractor based on calculating the difference between the power feedback 204A and 204B. The downhole tractor controller may identify an unbalance load condition when the difference between the power feedback of the tractors exceeds a predetermined threshold (e.g. difference is equal to or greater than about 5, 10, 15, 20, or 25% of the averaged tractor power), and then may readjust the power of each tractor to maintain the load 220 or equalize the power between the tractors using the power equalization algorithm. The adjusted power of each tractor may be designated as power reference offset 208A and 208B for the first tractor 202A and the second tractor 202B, respectively.

In some embodiments, the downhole tractor control system may further includes a first summing junction 216A at which the power reference offset 208A is summed with the power reference 210 to generate a modified power reference (as shown by arrow 212A) which is provided as an input to the first tractor 202A, and a second summing junction 216B at which the power reference offset 208B is summed with power reference 210 to generate a modified power reference (as shown by arrow 212B) which is provided as an input to the second tractor 202B. The downhole tractor control system may employ the power equalization algorithm to determine the modified power reference (e.g., 212A nd 212B) of each tractor based on the power reference offset (e.g., 208A and 208B) of each tractor, respectively. Furthermore, the power equalization algorithm may send different power reference (e.g., shown by block 210) commands to the downhole tractors 202A and 202B based on the power reference offset 208A and 208B to adjust the power feedback 204A and 204B, and thereby the load 220. In some examples, the downhole tractor control system may increase the power reference for the tractor that has lower power feedback and decrease the power reference for the tractor that has higher power feedback to balance the load among the tractors.

The downhole tractor control system 200 may further configure the modified power reference (212A and 212B) of each tractor with a configurable sampling rate and configurable averaging to send with different sampling frequencies to each tractor. More particularly, the downhole tractor control system 200 may be configured to have different sampling rates of sending modified power references 212A and 212B to each tractor, and have different averaging for calculating power reference offset (208A, 208B) for each tractor. The configurable sampling rate and averaging may be tuned based on system communication bandwidth. In the case of surface implementation, the modified power references may be sent via downlink which can have very low bandwidth. To be compatible with the disclosed systems, the power equalization algorithm may be configured to average the modified power reference within several sampling periods and send the modified power reference at a low frequency.

In some embodiments, the power unbalance detection may be implemented with a certain dead band that avoids too frequent actions under small power oscillating conditions, wherein the power reference offset may be implemented with zero values when the power feedback difference is below a minimum value. The power offset also has maximum values that avoid aggressive changes in the power performance.

Figure 3:
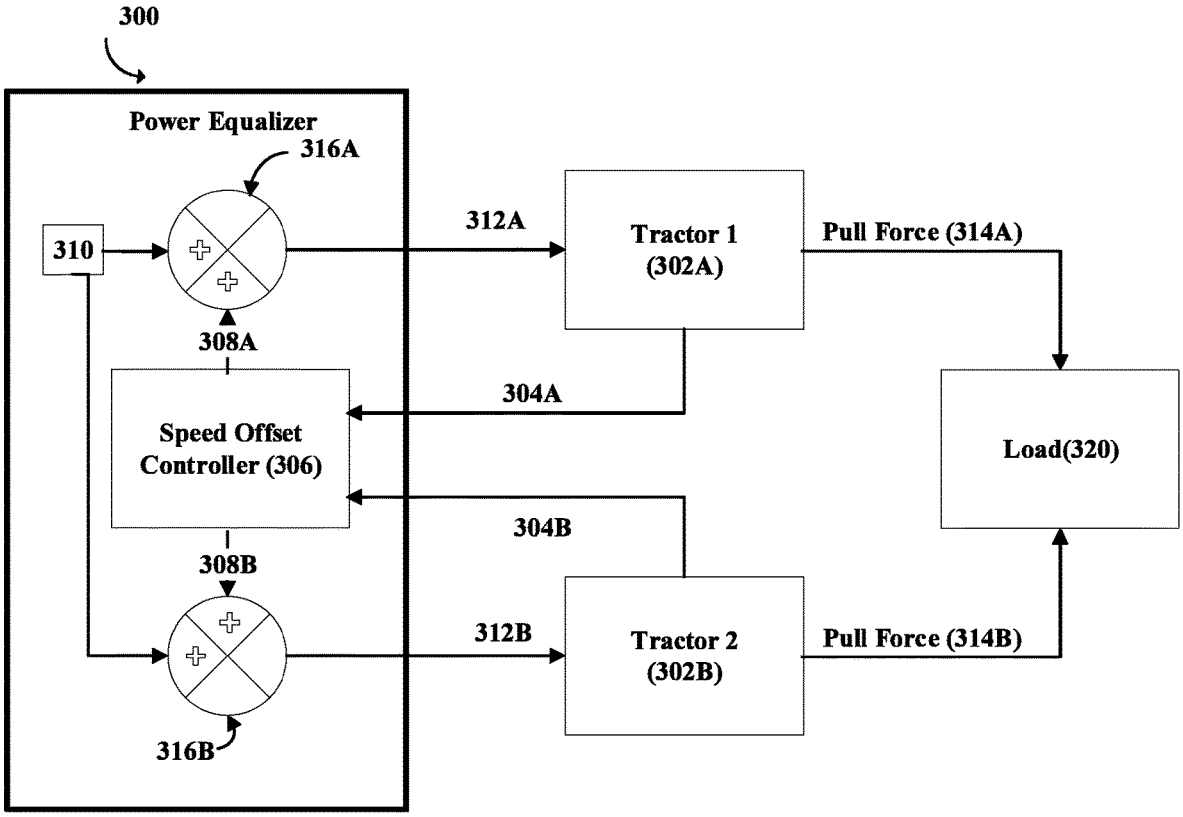
FIG. 3 illustrates another system diagram of a downhole tractor control system configured to balance a load among multiple downhole tractors in accordance with embodiments of the present disclosure.

FIG. 3 illustrates a system diagram of a downhole tractor control system 300 configured to balance a load 320 among multiple downhole tractors by adjusting the speed of each tractor. As shown in FIG. 3, in particular, the downhole tractor control system 300 may employ two tractors (302A, 302B) connected in a tool string for driving the load 320. In some embodiments, each tractor may comprise permanent magnet synchronous machine (PMSM) motors powering rotation of wheels. In one or more embodiments, a number of tractors may differ with different types of motors and a different number of motors. For example, each downhole tractor may have four motors such as induction motors, DC motors, or other types of motors. Each tractor has a speed reference 310 which is equal to the desired speed of the tool string. In some embodiments, the speed reference for each tractor may be provided by an operator. In some embodiments, the speed reference may be dynamically determined based on one or more downhole properties.

In some embodiments, the downhole tractor control system may then utilize feedback controllers to compare runtime power consumption (a.k.a feedback power) between tractors. The downhole tractor control system may enter the power feedback 304A, 304B received from each tractor (202A, 202B) respectively as an input of a speed offset controller 306, and obtain an output of the speed offset controller. The speed offset controller 306 may identify an unbalance load condition when a difference between the feedback power of the tractors exceeds a predetermined threshold. The speed offset controller output may be a speed reference offset 308A and speed reference offset 308B for each tractor 302A, 302B respectively. The speed reference offset is determined based on a difference between the power feedback of different tractors. The downhole tractor control system may adjust the speed of each tractor (302A, 302B) to maintain the load 320 or equalize the power between the tractors using the power equalization algorithm. The adjusted speed of each tractor may be designated as speed reference offset 308A and 308B for the first tractor 302A and the second tractor 302B, respectively.

The downhole tractor control system further includes a first summing junction 316A at which the speed reference offset 308A is summed with speed reference 310 to generate a modified speed reference (as shown by arrow 312A) which is provided as an input to tractor 302A, and a second summing junction 316B at which the power reference offset 308B is summed with speed reference 310 to generate a modified speed reference (as shown by arrow 312B) which is provided as an input to tractor 302B. The downhole tractor control system may employ the power equalization algorithm to determine the modified speed reference (e.g., 312A and 312B) based on the adjustment made to the speed reference offset (e.g., 308A and 308B) of each tractor.

In some embodiments, the power equalization algorithm may send different speed reference (e.g., shown by block 310) commands to the downhole tractors based on the speed reference offset 308A and 308B to adjust the power feedback 304A and 304B, and thereby the load 320. As an example, the downhole tractor control system may have the modified speed reference 312A with positive speed reference offset 308A (or higher speed reference) for the first tractor 302A that has lower power feedback such that it can speed up and increase its power to match with the second tractor 302B, and the modified speed reference 312B with negative speed reference offset 308B (or lower speed reference) for the second tractor 302B that has higher power feedback such that it can slow down and reduce its power to match with the first tractor 302A to balance the load 320 among the tractors 302A and 302B.

The downhole tractor control system may further configure the modified speed reference with configurable sampling rate and configurable averaging to send with different sampling frequencies to each tractor. The configurable sampling rate and averaging may be tuned based on system communication bandwidth. In the case of surface implementation, the modified speed references may be sent via downlink which can have very low bandwidth. To be compatible with this system, the power equalization algorithm may be configured to average the modified power reference within one sampling period and send the modified power reference at a low frequency.

In some embodiments, change in power may also be accomplished by sending different speed commands to the tractors. Thus, in that regards, to balance the load among multiple downhole tractors, the downhole tractor that has higher power feedback may receive lower speed reference such that it can slow down and reduce its power, and the downhole tractor that has lower power feedback may receive higher speed reference such that it can speed up and increase its power to match with another tractor.

Figure 4A:
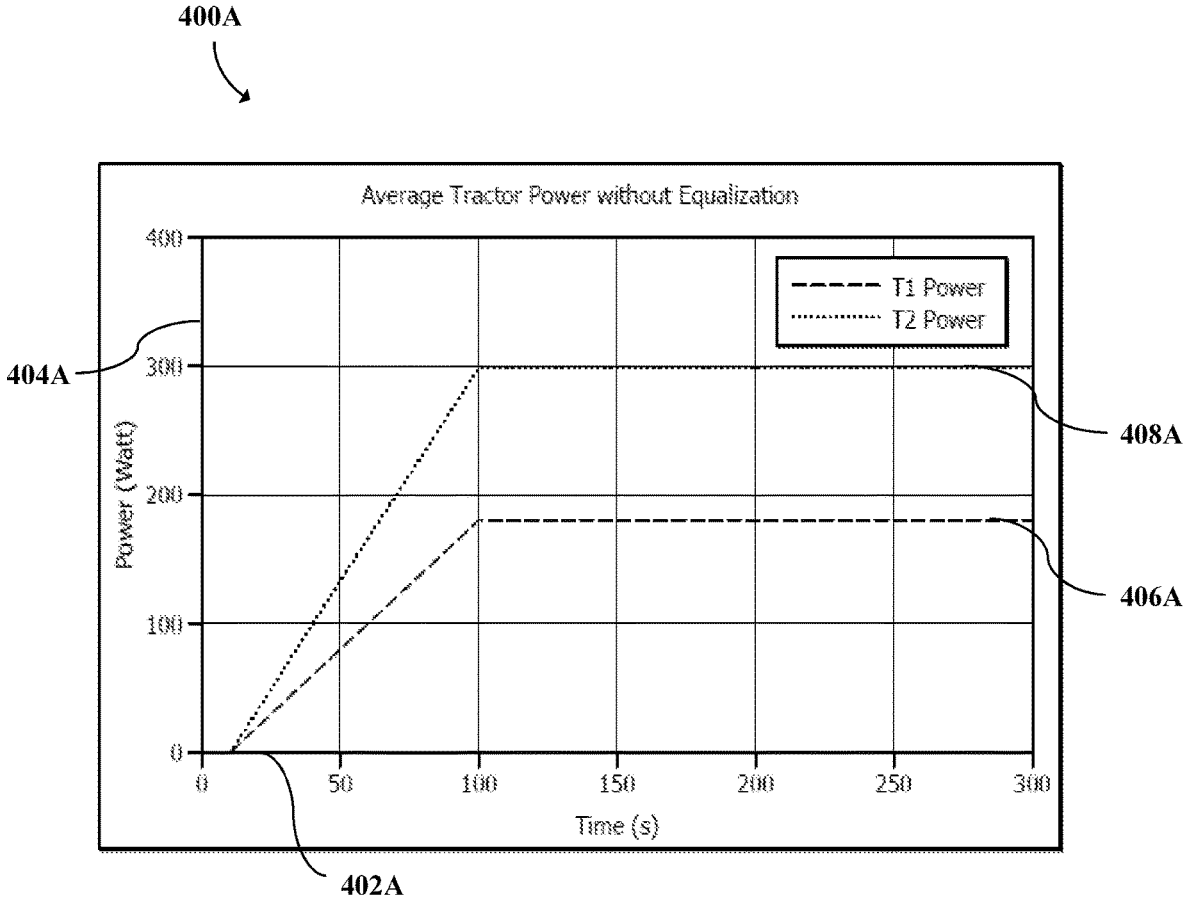
FIG. 4A illustrates simulated results of average output power of two tractors in absence of power equalization technique in accordance with embodiments of the present disclosure.

FIG. 4A illustrates simulated results of average tractor power of two tractors over time in absence of power equalization technique. FIG. 4A is a graph 400A of the average tractor power of two downhole tractors over time, where x-axis 402A may represent time and y-axis 404A may represents power. The line 406A may represent the average tractor power of a first tractor T1 and the line 408A may represent the average tractor power of a second tractor T2.

As it can be seen in FIG. 4A, the average tractor power of two tractors is tracked over time of about 5 minutes (i.e. 300 seconds). The first tractor T1 operates at an average motor output power of approximately 180 W, whereas the second tractor T2 operates at an average motor output power of approximately 300 W. Without using the power equalization technique, the output power of tractors cannot be adjusted based on their performance. This unbalanced power among tractors may cause mechanical and thermal stress on various power carrying parts of the tractors e.g., motors, transmission systems, etc. Depending on the overall power draw, this may further limit the net pull force of the tractors. However, as discussed in this disclosure, the downhole tractor control system may be configured to operate in such a way that the load among multiple downhole tractors may be balanced using the power equalization technique.

Figure 4B:
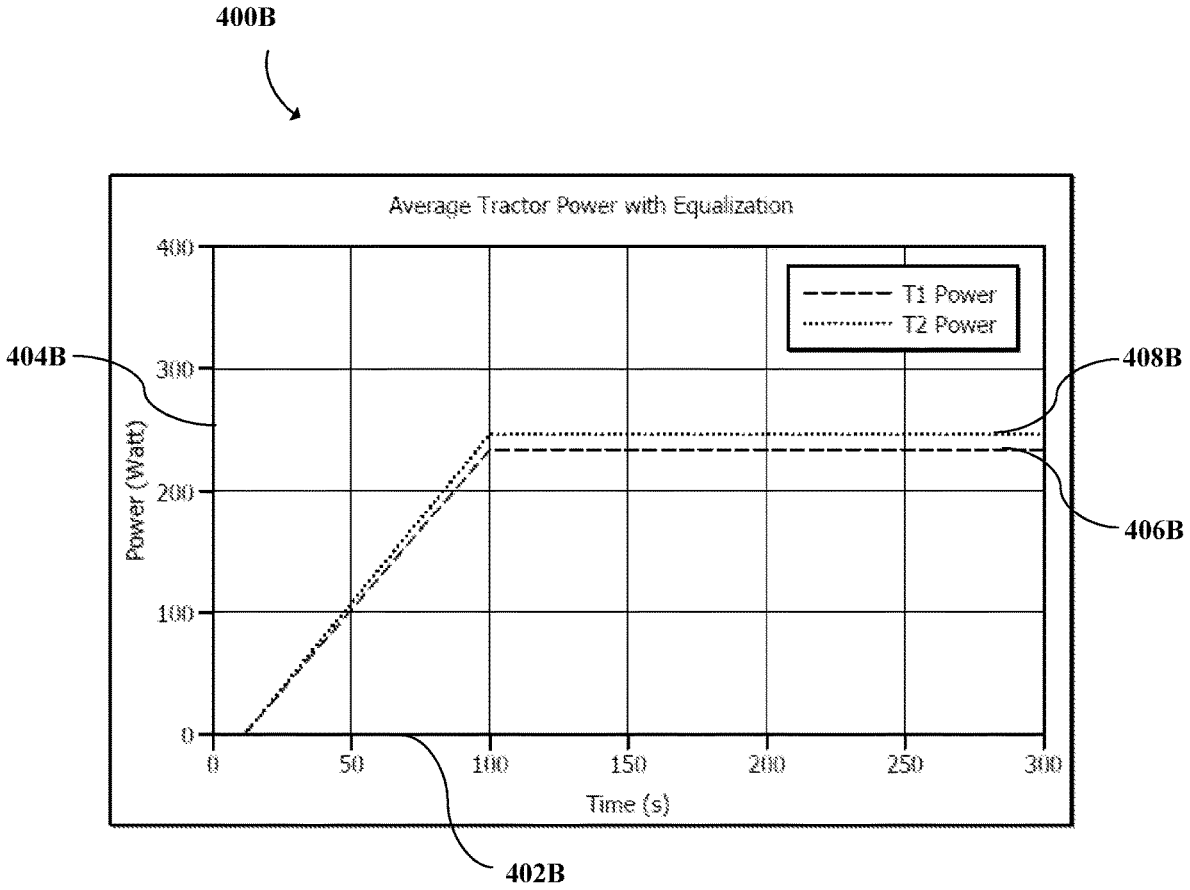
FIG. 4B illustrates simulated results of average output power of two tractors using power equalization technique in accordance with embodiments of the present disclosure.

FIG. 4B illustrates simulated results of the average tractor power of two tractors over time using the power equalization technique. FIG. 4B is a graph 400B of the average tractor power of two tractors over time, where x-axis 402B represents time and y-axis 404B may represents power. The line 406B may represent the average tractor power of a first tractor T1 and the line 408B may represent the average tractor power of a second tractor T2. As it can be seen in FIG. 4B, when the divergence (e.g., unbalance load condition) in power output begins to occur, real-time adjustment may be made with the power of each tractor. The power equalization algorithm may be utilized to increase the power reference for the tractor T1 to 240 W and decrease the power reference for the tractor T2 to 250 W to maintain a balance between the tractors.

The unbalance load condition may comprise malfunctioning or reduction in output power in one or more tractors depending on different properties of the wheels and different operating conditions of motors. As the multiple tractors are controlled separately, these conditions may cause the output power to unbalance between tractors. Thus, by utilizing the power equalizer or the power equalization algorithm, the downhole tractor control system may adjust or balance/equalize a load among multiple downhole tractors when one or more tractors are malfunctioning or the driving wheels of one or more tractors are slipping.

Figure 5:
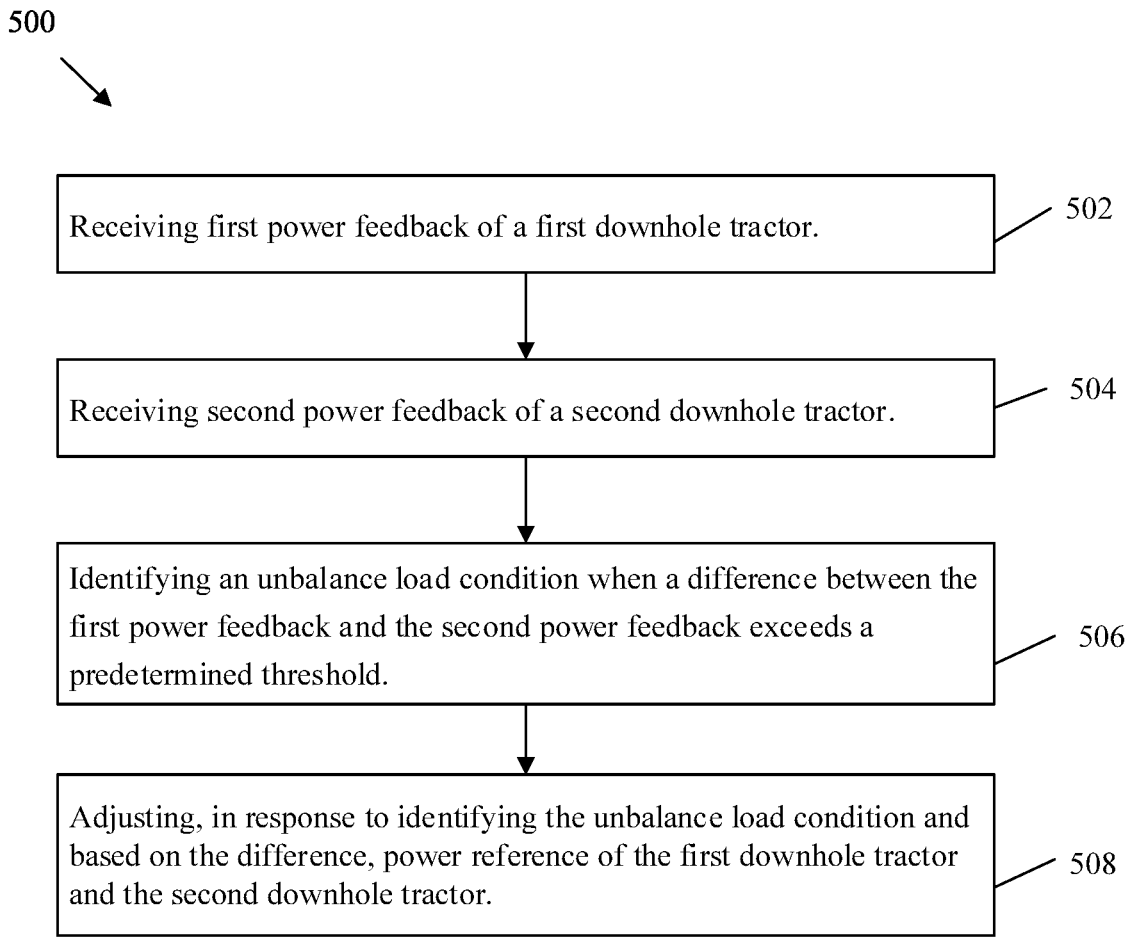
FIG. 5 illustrates a flow chart of a process to equalize the output power of multiple downhole tractors in accordance with embodiments of the present disclosure.

FIG. 5 illustrates a flow chart of an exemplary method 500 to equalize the power of multiple downhole tractors using a power equalization algorithm in accordance with embodiments of the present disclosure. For discussion purposes, the power equalization algorithm provided in this embodiment of this application may be performed by a downhole tractor control system. The downhole tractor control system may comprise a memory and a downhole processor (e.g., a digital signal processor (DSP) or the like). This is not limited in this embodiment of this application. The method may be implemented by using the following steps 502 to 508.

At step 502, the method 500 may comprise receiving first power feedback of a first downhole tractor.

At step 504, the method 500 may comprise receiving second power feedback of a second downhole tractor.

At step 506, the method 500 may comprise identifying an unbalance load condition when a difference between the first power feedback and the second power feedback exceeds a predetermined threshold.

At step 508, the method 500 may comprise adjusting, in response to the identifying the unbalance load condition and based on the difference, power reference of the first downhole tractor and the second downhole tractor. In some embodiments, adjusting the power reference comprises increasing a first power reference of the first downhole tractor that has lower power feedback, and decreasing a second power reference of the second downhole tractor that has higher power feedback.

Figure 6:
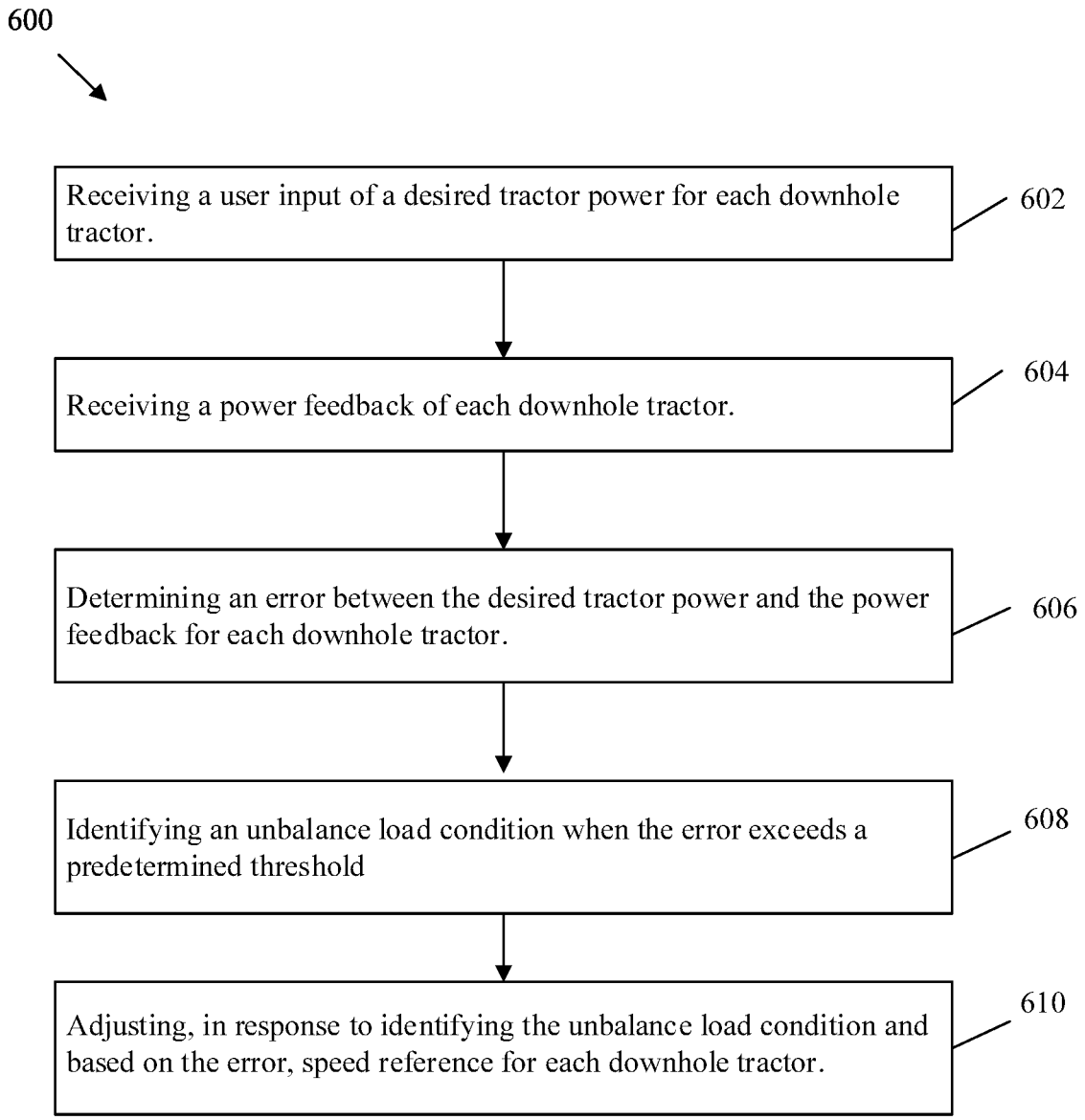
FIG. 6 illustrates a flow chart of a process to equalize the output power of multiple downhole tractors in accordance with embodiments of the present disclosure.

FIG. 6 illustrates a flow chart of a method to equalize the power of multiple downhole tractors in accordance with embodiments of the present disclosure. The method may be implemented by using the following steps 602 to 610.

At step 602, the method 600 may comprise receiving a user input of a desired tractor power for each downhole tractor.

At step 604, the method 600 may comprise receiving a power feedback of each downhole tractor.

At step 606, the method 600 may comprise determining an error between the desired tractor power and the power feedback for each downhole tractor.

At step 608, the method 600 may comprise identifying an unbalance load condition when the error exceeds a predetermined threshold.

At step 610, the method 600 may comprise adjusting, in response to the identifying the unbalance load condition and based on the error, speed reference for each downhole tractor. In some embodiments, the method 600 may further comprise receiving a lower speed command for a first downhole tractor that has higher power feedback, and receiving a higher speed command for a second downhole tractor that has lower power feedback.

ADDITIONAL DISCLOSURE

The following are non-limiting, specific embodiments in accordance with the present disclosure:

A first embodiment, which is a method to adjust a load among a plurality of downhole tractors, implemented by a downhole tractor control system, comprising receiving first power feedback of a first downhole tractor of the plurality of downhole tractors, receiving second power feedback of a second downhole tractor of the plurality of downhole tractors, identifying an unbalance load condition when a difference between the first power feedback and the second power feedback exceeds a predetermined threshold, and adjusting, in response to identifying the unbalance load condition and based on the difference, power reference of the first downhole tractor and the second downhole tractor.

A second embodiment, which is the method of the first embodiment, further comprising adjusting the power reference comprises increasing a first power reference of the first downhole tractor that has lower power feedback and decreasing a second power reference of the second downhole tractor that has higher power feedback.

A third embodiment, which is the method of any of the first and the second embodiments, further comprising adjusting the power reference of the first downhole tractor and the second downhole tractor using a power equalization algorithm.

A fourth embodiment, which is the method of any of the first through the third embodiments, wherein the downhole tractor control system is either located at a surface of a well or coupled to the downhole tractors.

A fifth embodiment, which is the method of any of the first through the fourth embodiments, wherein the power reference is a desired input power of the first downhole tractor and the second downhole tractor.

A sixth embodiment, which is the method of any of the first through the fifth embodiments, further comprising sending commands to adjust power reference of the first downhole tractor and the second downhole tractor with a configurable sampling rate and configurable averaging.

A seventh embodiment, which is the method of any of the first through the sixth embodiments, wherein the configurable sampling rate and the configurable averaging are tuned based on system communication bandwidth.

An eighth embodiment, which is the method of any of the first through the seventh embodiments, wherein the first downhole tractor and the second downhole tractor are coupled to each other on a same tool string.

A ninth embodiment, which is the method of any of the first through the eighth embodiments, wherein the difference between the first power feedback and the second power feedback is determined using a feedback controller, and wherein the feedback controller comprises a proportional-integral controller or a proportional-integral-derivative controller.

A tenth embodiment, which is a downhole tractor control system, comprising a memory comprising instructions and a processor coupled to the memory and configured to receive first power feedback of a first downhole tractor, receive second power feedback of a second downhole tractor, identify an unbalance load condition when a difference between the first power feedback and the second power feedback exceeds a predetermined threshold, and adjust, in response to the identification and based on the difference, power reference of the first downhole tractor and the second downhole tractor.

An eleventh embodiment, which is the downhole tractor control system of the tenth embodiment, wherein the processor is further configured to increase a first power reference of the first downhole tractor that has lower power feedback, and decrease a second power reference of the second downhole tractor that has higher power feedback.

A twelfth embodiment, which is the downhole tractor control system of any of the tenth through the eleventh embodiments, wherein the processor is further configured to adjust the power reference of the first downhole tractor and the second downhole tractor using a power equalization algorithm.

A thirteenth embodiment, which is the downhole tractor control system of any of the tenth through the twelfth embodiments, wherein the power reference is a desired input power of the first downhole tractor and the second downhole tractor.

A fourteenth embodiment, which is the downhole tractor control system of any of the tenth through the thirteenth embodiments, wherein the downhole tractor control system is located either at a surface of a well or is coupled to the downhole tractors.

A fifteenth embodiment, which is the downhole tractor control system of any of the tenth through the fourteenth embodiments, wherein the processor is further configured to send commands to adjust the power reference of the first downhole tractor and the second downhole tractor with a configurable sampling rate and configurable averaging.

A sixteenth embodiment, which is the downhole tractor control system of any of the tenth through the fifteenth embodiments, wherein the configurable sampling rate and the configurable averaging are tuned based on system communication bandwidth.

A seventieth embodiment, which is the downhole tractor control system of any of the tenth through the sixteenth embodiments, wherein the first downhole tractor and the second downhole tractor are coupled to each other on a same tool string.

An eighteenth embodiment, which is a method to adjust a load among a plurality of downhole tractors, implemented by a downhole tractor control system, comprising receiving a user input of a desired tractor power for each downhole tractor, receiving a power feedback of each downhole tractor, determining an error between the desired tractor power and the power feedback for each downhole tractor, and identifying an unbalance load condition when the error exceeds a predetermined threshold, and adjusting, in response to identifying the unbalance load condition and based on the error, speed reference for each downhole tractor.

A nineteenth embodiment, which is the method of the eighteenth embodiment, further comprising adjusting the power feedback of each downhole tractor by sending different speed commands to the tractors.

A twentieth embodiment, which is the method of any of the eighteenth through the nineteenth embodiments, further comprising receiving a lower speed command for a first downhole tractor that has higher power feedback, and receiving a higher speed command for a second downhole tractor that has lower power feedback.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Use of the term "optionally" with respect to any element of a claim is intended to mean that the subject element may be present in some embodiments and not present in other embodiments. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of this disclosure. Thus, the claims are a further description and are an addition to the embodiments of this disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A method to adjust a load among a plurality of downhole tractors, implemented by a downhole tractor control system, the method comprising:

receiving first power feedback of a first downhole tractor of the plurality of downhole tractors;

receiving second power feedback of a second downhole tractor of the plurality of downhole tractors;

identifying an unbalance load condition when a difference between the first power feedback and the second power feedback exceeds a predetermined threshold; and adjusting, in response to identifying the unbalance load condition and based on the difference, a power reference of the first downhole tractor and the second downhole tractor to generate a linear pull force, wherein adjusting the power reference comprises:

increasing a first power reference of the first downhole tractor that has lower power feedback; and decreasing a second power reference of the second downhole tractor that has higher power feedback.

2. The method of claim 1, further comprising adjusting the power reference of the first downhole tractor and the second downhole tractor using a power equalization algorithm.

3. The method of claim 1, wherein the downhole tractor control system is either located at a surface of a well or coupled to the downhole tractors.

4. The method of claim 1, further comprising adjusting the power reference of the first downhole tractor and the second downhole tractor by sending commands with a configurable sampling rate and configurable averaging.

5. The method of claim 4, wherein the configurable sampling rate and the configurable averaging are tuned based on system communication bandwidth.

6. The method of claim 1, wherein the first downhole tractor and the second downhole tractor are coupled to each other on a same tool string.

7. The method of claim 1, wherein the difference between the first power feedback and the second power feedback is determined using a feedback controller, and wherein the feedback controller comprises a proportional-integral controller or a proportional-integral-derivative controller.

8. The method of claim 1, wherein the power reference is a desired input power of the first downhole tractor and the second downhole tractor.

9. A downhole tractor control system, comprising:
a memory comprising instructions; and
a processor coupled to the memory and configured to:
receive first power feedback of a first downhole tractor;
receive second power feedback of a second downhole tractor;
identify an unbalance load condition when a difference between the first power feedback and the second power feedback exceeds a predetermined threshold; and
adjust, in response to identifying the unbalance load condition and based on the difference, a power reference of the first downhole tractor and the second downhole tractor to generate a linear pull force, wherein to adjust the power reference, the processor is further configured to:
increase a first power reference of the first downhole tractor that has lower power feedback; and
decrease a second power reference of the second downhole tractor that has higher power feedback.

10. The downhole tractor control system of claim 9, wherein the processor is further configured to adjust the power reference of the first downhole tractor and the second downhole tractor using a power equalization algorithm.

11. The downhole tractor control system of claim 9, wherein the downhole tractor control system is located either at a surface of a well or is coupled to the downhole tractors.

12. The downhole tractor control system of claim 9, wherein the power reference is a desired input power of the first downhole tractor and the second downhole tractor.

13. The downhole tractor control system of claim 9, wherein the processor is further configured to adjust the power reference of the first downhole tractor and the second downhole tractor by sending commands with a configurable sampling rate and configurable averaging.

14. The downhole tractor control system of claim 13, wherein the configurable sampling rate and the configurable averaging are tuned based on system communication bandwidth.

15. The downhole tractor control system of claim 9, wherein the first downhole tractor and the second downhole tractor are coupled to each other on a same tool string.

16. A method to adjust a load among a plurality of downhole tractors, implemented by a downhole tractor control system, the method comprising:
receiving a user input of a desired tractor power for each downhole tractor;
receiving a power feedback of each downhole tractor;
determining an error between the desired tractor power and the power feedback for each downhole tractor;
identifying an unbalance load condition when the error exceeds a predetermined threshold; and
adjusting, in response to identifying the unbalance load condition and based on the error, a speed reference for each downhole tractor to generate a linear pull force, wherein adjusting the speed reference comprises:
receiving a lower speed command for a first downhole tractor that has higher power feedback; and
receiving a higher speed command for a second downhole tractor that has lower power feedback.

17. The method of claim 16, further comprising adjusting the power feedback of each downhole tractor by sending different speed reference commands to the tractors.

* * * * *